US009689109B2

(12) United States Patent
Lyu

(10) Patent No.: US 9,689,109 B2
(45) Date of Patent: Jun. 27, 2017

(54) STEAM GENERATOR AND LAUNDRY TREATMENT APPARATUS INCLUDING THE SAME

(71) Applicant: LG ELECTRONICS INC., Seoul (KR)

(72) Inventor: Hyunkwan Lyu, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 0 days.

(21) Appl. No.: 14/861,431

(22) Filed: Sep. 22, 2015

(65) Prior Publication Data

US 2016/0090683 A1 Mar. 31, 2016

(30) Foreign Application Priority Data

Sep. 29, 2014 (KR) ..... 10-2014-0130034

(51) Int. Cl.
*D06F 58/28* (2006.01)
*D06F 58/20* (2006.01)
*D06F 73/02* (2006.01)

(52) U.S. Cl.
CPC ..... *D06F 58/203* (2013.01); *D06F 58/28* (2013.01); *D06F 73/02* (2013.01); *D06F 2058/2816* (2013.01); *D06F 2058/2829* (2013.01); *D06F 2058/2835* (2013.01); *D06F 2058/2838* (2013.01); *D06F 2058/2896* (2013.01)

(58) Field of Classification Search
CPC ..... D06F 58/00; D06F 58/12; D06F 58/20; D06F 58/28; D06F 58/203; D06F 2058/2816; D06F 2058/2829; D06F 2058/2835; D06F 2058/2838; D06F 2058/2896; F26B 19/00; F26B 21/00; F26B 21/06
USPC ..... 34/497, 595, 381; 8/139, 149; 68/5 C, 68/5 R, 19, 20
See application file for complete search history.

(56) References Cited

U.S. PATENT DOCUMENTS 5,388,180 A 2/1995 Bayles
5,651,192 A * 7/1997 Horwitz ..... D06F 58/28 219/494
5,782,012 A * 7/1998 Sanders ..... D06F 58/28 34/527

(Continued)

FOREIGN PATENT DOCUMENTS

BE EP 1852541 A1 * 11/2007 ..... D06F 58/203
CN 101006222 7/2007

(Continued)

OTHER PUBLICATIONS

United States Office Action dated Aug. 26, 2016 issued in U.S. Appl. No. 14/861,335.

(Continued)

*Primary Examiner* — Stephen M Gravini
(74) *Attorney, Agent, or Firm* — KED & Associates, LLP

(57) ABSTRACT

A method of the present disclosure includes a first operation of supplying hot air to laundry until the dryness of the laundry has reached a predetermined standard dryness, and a second operation of alternately performing a moisture supply operation of supplying moisture to the laundry and a hot air supply operation of supplying hot air to the laundry.

8 Claims, 8 Drawing Sheets

(56) References Cited

U.S. PATENT DOCUMENTS

| | | | | |
|---|---|---|---|---|
| 7,146,749 | B2 * | 12/2006 | Barron | D06F 58/203 34/596 |
| 7,325,330 | B2 * | 2/2008 | Kim | D06F 25/00 134/22.1 |
| 7,681,418 | B2 * | 3/2010 | Wong | D06F 39/008 68/12.03 |
| 7,921,578 | B2 * | 4/2011 | McAllister | D06F 35/00 134/10 |
| 8,104,191 | B2 * | 1/2012 | Ricklefs | D06F 58/203 34/474 |
| 8,544,187 | B2 * | 10/2013 | Choi | D06F 58/28 34/407 |
| 8,549,770 | B2 * | 10/2013 | Bellinger | D06F 58/28 34/486 |
| 8,832,965 | B2 * | 9/2014 | Son | D06F 33/02 34/413 |
| 8,844,160 | B2 * | 9/2014 | Beihoff | D06F 58/203 34/409 |
| 9,435,069 | B2 * | 9/2016 | Contarini | D06F 58/206 |
| 2006/0005581 | A1 * | 1/2006 | Banba | D06F 25/00 68/5 R |
| 2008/0115740 | A1 | 5/2008 | You | |
| 2008/0256720 | A1 * | 10/2008 | Park | D06F 25/00 8/149.3 |
| 2008/0313922 | A1 * | 12/2008 | Bae | D06F 58/203 34/491 |
| 2010/0050464 | A1 * | 3/2010 | Krzelowski | D06F 58/203 34/380 |
| 2014/0069152 | A1 | 3/2014 | Song et al. | |
| 2016/0090680 | A1 * | 3/2016 | Lyu | D06F 39/008 68/5 C |
| 2016/0090683 | A1 * | 3/2016 | Lyu | D06F 73/02 34/389 |

FOREIGN PATENT DOCUMENTS

| | | | | |
|---|---|---|---|---|
| CN | 100494551 | | 6/2009 | |
| CN | 103657918 | | 3/2014 | |
| EP | 1 916 326 | A1 | 4/2008 | |
| EP | 2 267 209 | A1 | 12/2010 | |
| EP | 2 703 542 | A2 | 3/2014 | |
| EP | 2 889 414 | A1 | 7/2015 | |
| JP | H 01-178900 | | 12/1989 | |
| JP | 2014-171561 | | 9/2016 | |
| KR | EP 3000930 | A1 * | 3/2016 | D06F 73/02 |
| WO | WO 2014/141714 | | 9/2014 | |

OTHER PUBLICATIONS

European Search Report dated Feb. 23, 2016 issued in Application No. 15185118.5.

European Search Report dated Feb. 26, 2016 issued in Application No. 15185130.0.

U.S. Appl. No. 14/861,335, filed Sep. 22, 2015.

Chinese Office Action dated Mar. 24, 2017 issued in Application No. 2015-10632268.1 (with English translation).

Chinese Office Action dated Mar. 20, 2017 issued in Application No. 201510638913.0 (with English Translation).

* cited by examiner

STEAM GENERATOR AND LAUNDRY TREATMENT APPARATUS INCLUDING THE SAME

CROSS-REFERENCE TO RELATED APPLICATION

This application claims priority under 35 U.S.C. §119 to Korean Patent Application No. 10-2014-0130034, filed on Sep. 29, 2014, whose entire disclosure is hereby incorporated by reference.

BACKGROUND

1. Field

The present disclosure relates to a steam generator, a laundry treatment apparatus including the same, and a method of controlling the laundry treatment apparatus.

2. Background

Generally, the term "laundry treatment apparatus" refers to household appliances including a washing apparatus, for removing contaminants from laundry by the interaction between washing water supplied therein and detergent, and a drying apparatus, for drying laundry by supplying hot air to wet laundry. Among recent laundry treatment apparatuses, there are examples capable of sterilizing laundry and removing smells and wrinkles using a steam generator. A general steam generator includes a storage space for containing water supplied from the outside and a heater provided in the storage space so as to directly contact the water contained in the storage space.

Since such a steam generator is operated in such a way as to activate the heater after the storage space has been filled with a predetermined amount of water, it is possible to supply steam only when the water in the storage space is boiled. Accordingly, such steam generator takes too much time to generate steam, and there is difficulty in controlling the pressure of the steam discharged from the steam generator.

The steam generator is also constructed so as to generate steam from water supplied from a water source provided in a home, and components (calcium, magnesium, basic substances, and the like) contained in the water adhere with each other during a heating procedure and form a scale (calcium carbonate, magnesium sulfate, and the like) in the storage space. When the scale is generated in the storage space, the scale may plug a discharge member, through which steam is discharged to the outside of the storage space.

Although the scale remaining in the storage space adheres firmly to surfaces of the storage space and a heater, the scale present in higher regions is separated from surfaces of the storage or the heater in the event of overheating of the heater or imbalance of the temperature inside the storage space. Hence, a discharge member may be plugged or clogged with the scale. Since a general steam generator activates a heater only when the heater is completely immersed in water for safety, water further needs to be resupplied to the storage space, even when a considerable amount of water remains in the storage space. Such resupply increases water consumption.

Because different types of laundry have varying moisture content, there may be a risk of damaging laundry when hot air is supplied to the laundry for a period of time determined based on the amount of clothes. The time required for laundry having a higher moisture content to be dried to a desired level and the time required for laundry having a lower moisture content to be dried to the desired level are different from each other. The laundry having a lower moisture content may be damaged due to overdrying when hot air is supplied until both types of laundry reach the desired level of dryness.

BRIEF DESCRIPTION OF THE DRAWINGS

The embodiments will be described in detail with reference to the following drawings in which like reference numerals refer to like elements wherein.

DETAILED DESCRIPTION

Figure 1:
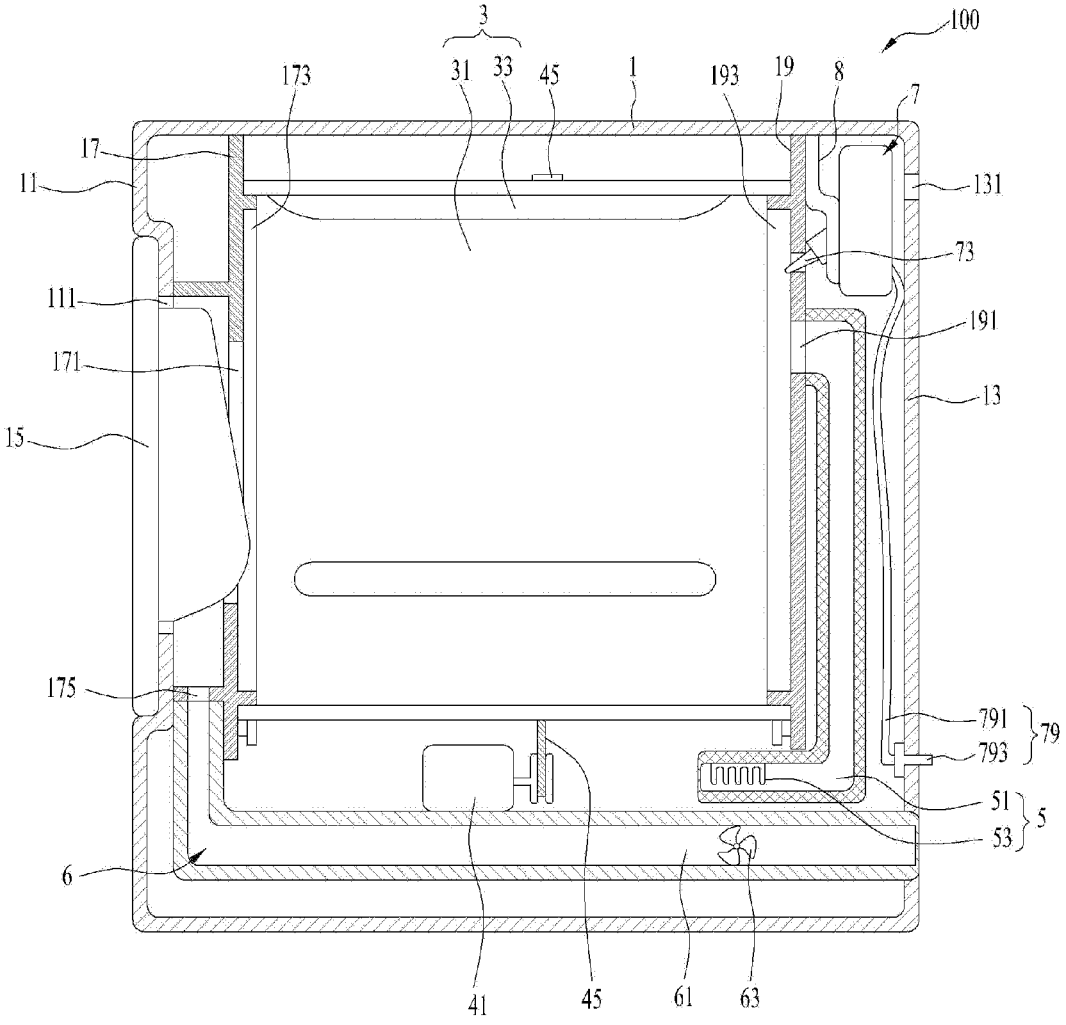
FIG. 1 is an elevation view showing a laundry treatment apparatus according to an embodiment of the present disclosure.

As shown in FIG. 1, a laundry treatment apparatus 100 according to an embodiment of the present disclosure includes a cabinet 1, a container 3 disposed in the cabinet to contain or hold laundry, and a moisture supply unit (see, e.g., FIG. 2) for supplying moisture or steam to the container 3.

The cabinet 1 includes a front panel 11 disposed at the front face of the laundry treatment apparatus. The front panel 11 is provided with an introduction port 111 communicating with the container 3. The introduction port 111 is opened and closed by means of a door that is rotatably coupled to the cabinet 1. The container 3 may be configured to have any shape as long as it communicates with the introduction port 111. As an example of the container 3, FIG. 1 illustrates a cylindrical container body 31 that opens at the front and rear faces thereof.

The cabinet 1 may include a first support 17 and a second support 19 for supporting the container body 31. The first support 17 includes a through hole 171 communicating with the introduction port 111. A user may put laundry into the container body 31 and remove it therefrom through the introduction port 111 and the through hole 171. The first support 17 is provided with a first flange 173 for rotatably supporting the open front face of the container body 31, and the second support 19 is provided with a second flange 193 for rotatably supporting the open rear face of the container body 31.

The container 3, may be rotated by a drive unit or a driving assembly. The drive unit may include a motor 41 and a belt 45 for connecting the rotating shaft of the motor 41 to the outer circumferential surface of the container body 31. When the container body 31 is rotatable, the container body 31 may further be provided on the inner surface thereof with lifters 33 that protrude toward the rotational center of the container body 31 to agitate the laundry. The container 3 may be supplied with hot air from a hot air supply unit or module 5, and the air in the container 3 may be discharged to the outside through a discharge unit or air discharge duct 6.

The hot air supply unit 5 may include an air supply duct 51 communicating with the container body 31 and a heater 53 for heating the air introduced in the supply duct 51. The discharge unit 6 may include an air discharge duct 61 for allowing the inside of the container body 31 to communicate with the outside of the cabinet 1, and a fan 63 disposed in the air discharge duct 61.

The discharge duct 61 may communicate with the container body 31 through a discharge hole 175 formed in the first support 17, and the supply duct 51 may communicate with the container body 31 through a communication hole 191 formed in the second support 19. When the air in the container body 31 is discharged to the outside of the cabinet 1 by the rotation of the fan 63, the air in the cabinet 1 will be introduced into the container body 31 through the supply duct 51 due to the drop in the internal pressure of the container body 31. When the heater 53 is activated at this time, the heated air (hot air) will be supplied to the container body 31.

In order to allow air to be efficiently supplied to the container body 31, the cabinet 1 may further include a panel through hole 131 for allowing the inside of the cabinet to communicate with the outside of the cabinet 1. FIG. 1 illustrates an example in which the panel through hole 131 is formed in the rear panel 13 of the cabinet 1. Although FIG. 1 illustrates the laundry treatment apparatus 100, which is constructed in such a way as to discharge air that has been discharged from the container body 31 to the outside of the cabinet 1 (e.g., a discharge type dryer), the laundry treatment apparatus according to the present disclosure may be constructed in such a way as to circulated air in the container body 31 (e.g., a condensing type dryer).

When the laundry treatment apparatus is embodied as the condensing type dryer, the discharge duct 61 may be connected to the supply duct 51 so as to supply air discharged from the container body 31 to the container body 31 again. Furthermore, since the air discharged from the container body 31 is dehumidified and then supplied to the heater 53, the discharge duct 61 must further include a dehumidification device.

The moisture supply unit or module for supplying moisture to the container 3 may be embodied as a unit for supplying droplets that have not been heated to the container 3, or may be embodied as a unit for supplying steam to the container 3 (a steam generator). Hereinafter, the present disclosure will be described under the assumption that the moisture supplying module of the container 3 is embodied as a steam generator 7.

Figure 2:
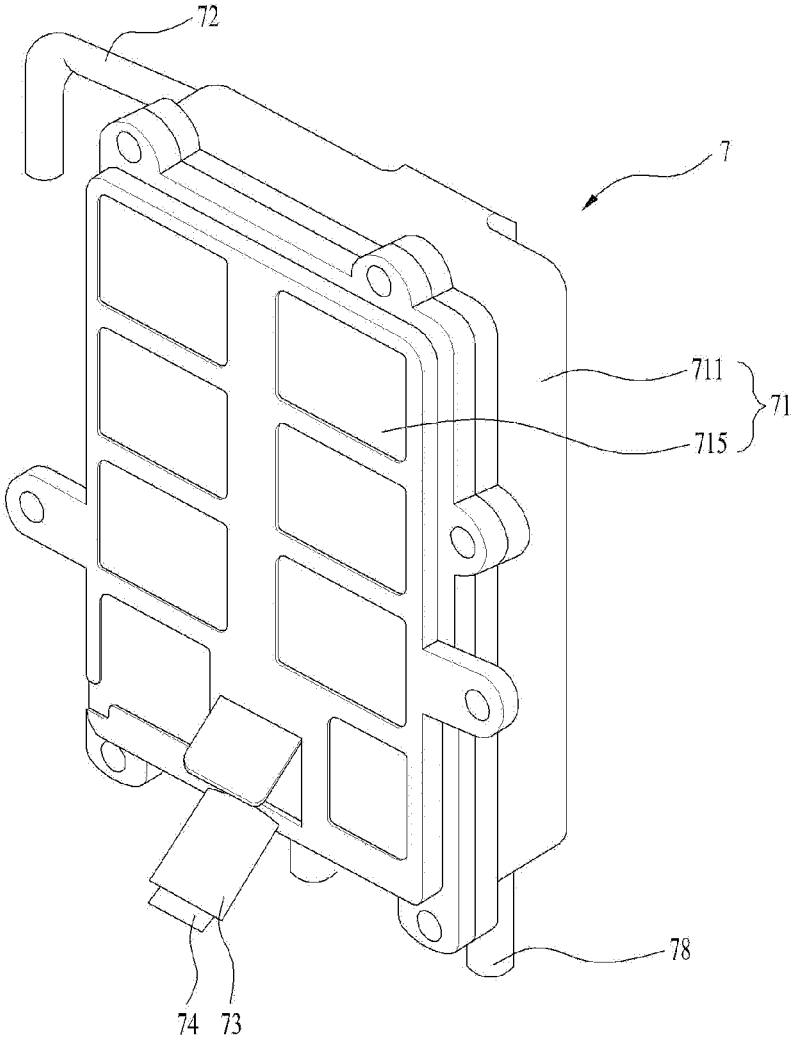
FIGS. 2 and 3 are views showing a steam generator according to the embodiment of the present disclosure.

As shown in FIG. 2, the steam generator 7 according to the embodiment of the present disclosure includes a generator body 71 having a space for containing fluid, an introduction part or inlet tube 72 for allowing fluid (water or droplets) to be supplied to the generator body 71, a discharge part or outlet port 73 for allowing the fluid in the generator body 71 to be discharged therethrough, and a heating part or heater 78 for heating the generator body 71.

Figure 3:
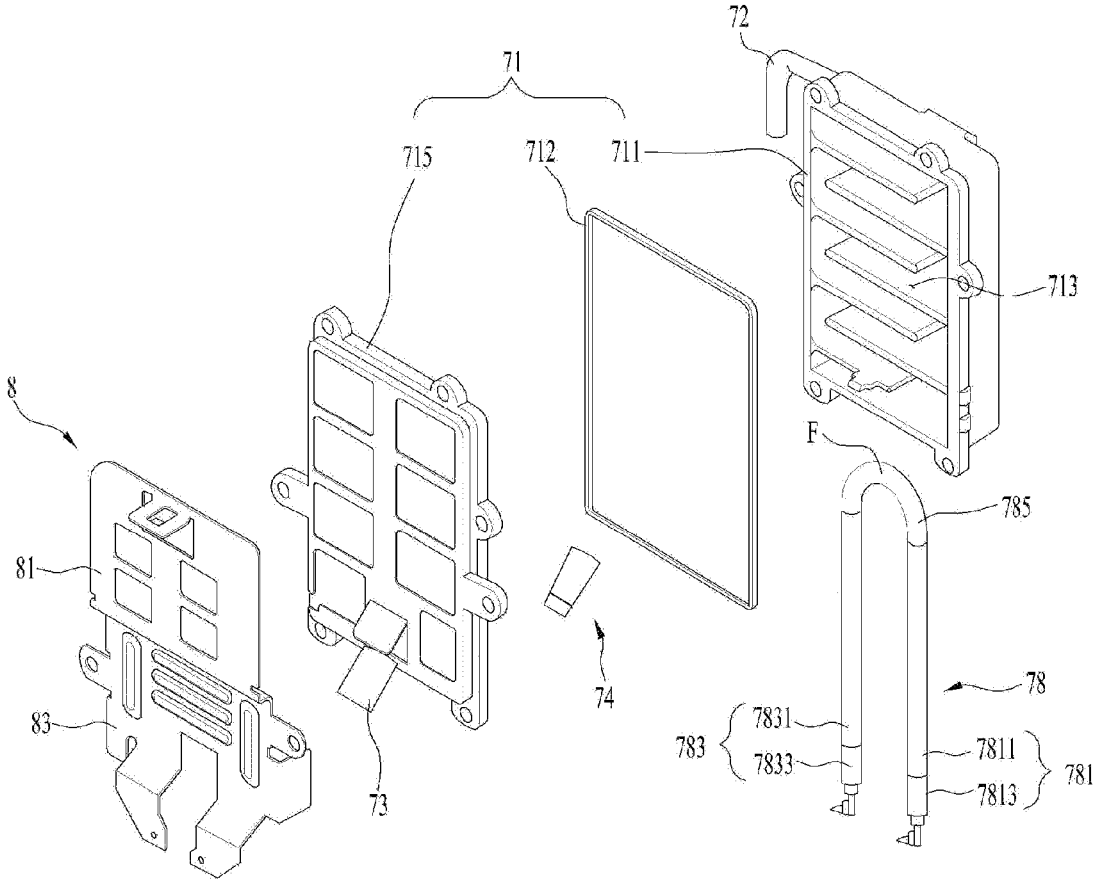

As shown in FIG. 3, the generator body 71 may include a first body 711 coupled to a second body 715. The first body 711 may be provided with a storage compartment 713 for storing water therein, and the second body 715 may be coupled to the first body 711 to hermetically close the storage compartment 713. For the purpose of hermetically closing the storage compartment 713, a seal 712 may be provided at the mating surfaces of the first body 711 and the second 715.

The introduction part or inlet tube 72 is provided at one of the first body 711 and the second body 715 so as to communicate with the storage compartment 713. FIG. 3 illustrates an example in which the introduction part 72 is connected to the first body 711 to communicate with the storage compartment 713. The introduction part 72 may be connected to a water source through a water supply unit 79 (see FIG. 1). The water supply unit 79 may include water supply pipe 791 for connecting the introduction part 72 to the water source. The water supply pipe 791 may be opened and closed by a valve 793.

The discharge part or outlet port 73 with a nozzle 74 is also provided at one of the first body 711 and the second body 715 to communicate with the storage compartment 713. FIG. 3 illustrates an example in which the discharge part 73 is connected to the second body 715 so as to communicate with the storage compartment 713. The discharge part 73 may be connected to the first support 17 so as to supply steam to the container 3, or may be connected to the second support 19 so as to supply steam to the container 3.

FIG. 1 illustrates an example in which the discharge part 73 is connected to the second support 19. The steam generator 7 is may secured to the second support 19 for reducing the phase-change (condensation) of steam as the length of the discharge part 73 is decreased.

As the length of the discharge part 73 is increased, there is a possibility that the steam moving toward the container along the discharge part 73 is partially condensed in the discharge part 73. When the steam generator 7 is secured to the second support 19, the length of the discharge part 73 may be minimized, thus minimizing the condensation of steam in the discharge part 73.

The steam generator 7 may be secured to the second support 19 by a bracket 8. As shown in FIG. 3, the bracket 8 may include a first securing part or first bracket plate 81 secured to the second support 19 and a second securing part or second bracket plate 83 secured to the generator body 71. Because substantially the entire area of the generator body 71 is heated by the heating part 78, securing the generator body 71 to the surface of the second support 19 or the surface of the cabinet 1 may cause deformation of the second support 19 or the cabinet 1, and there may be an increase in time required for the generation of steam due to heat loss.

Accordingly, the securing part 83 may secure the generator body 71 to the second support 19 such that the generator body 71 is spaced apart from the surface of the second support 19 by a predetermined distance and is also spaced apart from the cabinet 1 by a predetermined distance (see, e.g., FIG. 1). The steam generator 7 may be positioned at the upper end of the second support 19 so as to supply steam sprayed from the discharge part 73 up to the front of the container body 31 (the area where the first support 17 is positioned). The steam generator 7 is positioned above the rotational center of the container body 31 by the bracket 8.

Figure 4A:
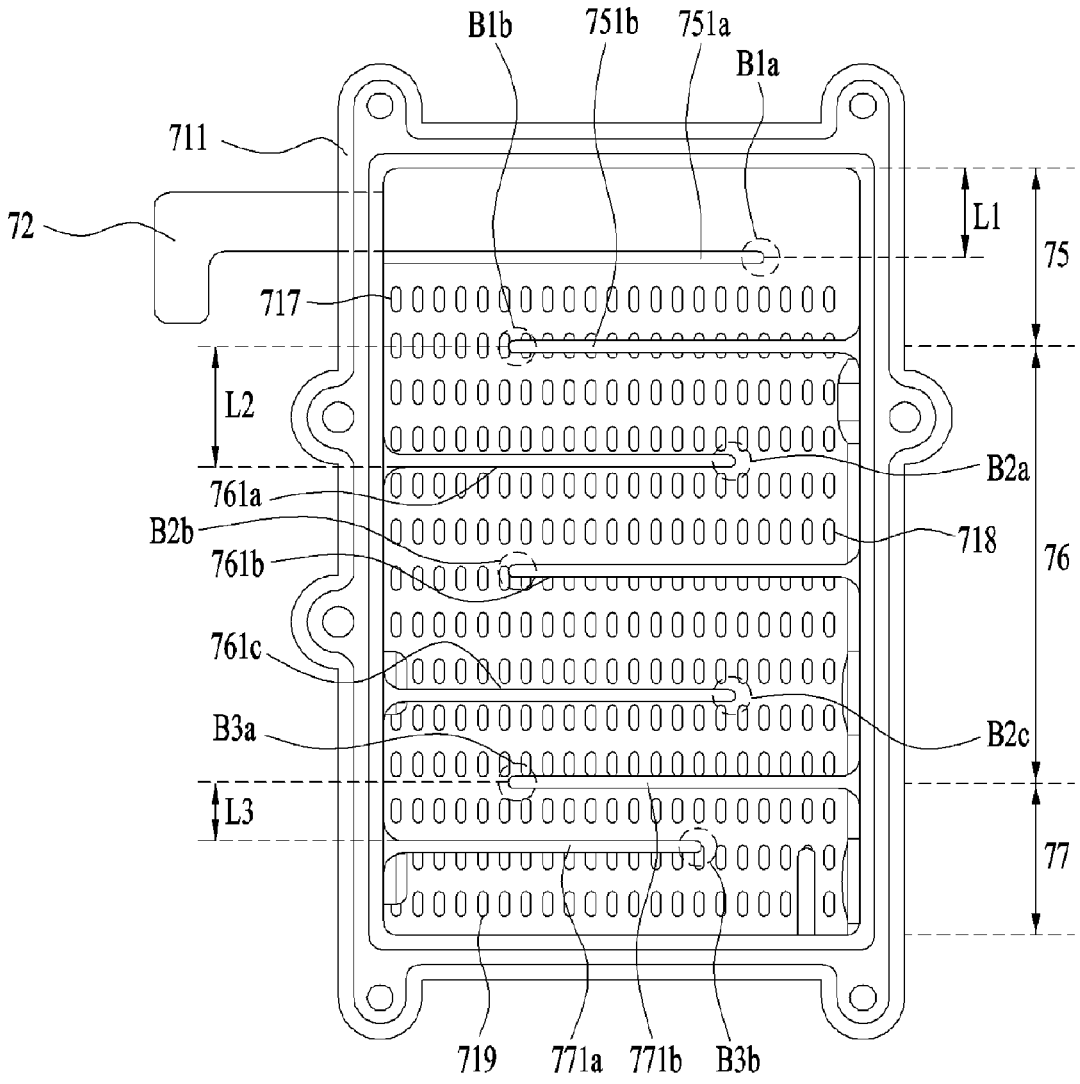
FIGS. 4A and 4B are views showing the internal structure of the steam generator.

As shown in FIG. 4, the generator body 71 is provided therein with a flow channel for guiding fluid supplied from the introduction part 71 toward the discharge part 73. The flow channel may include first, second and third flow channels 75, 76 and 77. The first flow channel 75 communicates with the introduction part 72, and a second flow channel 76 provided between the first and third flow channels 75 and 77. The third flow cannel communicates with the discharge part 73. The first flow channel 75 may be defined by at least one first partition 751 provided in the storage compartment 713. The first flow channel 75 is configured to have at least one flow inflection portion or curved ends B1*a* or B1*b*.

The first partition 751 may include first and second partitions 751*a* and 751*b*. The first partition 751*a*, extends from the side surface (the left side surface of the generator body 71 in FIG. 4) of the generator body 71 to which the introduction part 72 is connected toward the right side surface of the generator body 71. The second partition 751*b*, extends from the right side surface of the generator body 71 toward the left side surface of the generator body 71. The first and second of first partitions 751*a* and 751*b* constituting the first partition 751 may be spaced apart from each other by a predetermined distance L1, and the free curved ends or inflection portions B1*a* or B1*b* of the first and second of first partitions 751*a* and 751*b* do not contact the left or right side surfaces of the generator body 71.

The second flow channel 76, which serves to guide fluid discharged from the first flow channel 75 toward the third flow channel 77, may be defined by at least one second partition 761 provided in the storage compartment 713. The second flow channel 76 may also be configured to have at least one flow inflection portion B2*a* (B2*b* or B2*c*). The second partition 761 may include a first partition 761*a*, a second partition 761*b* and a third partition 761*c*.

The first partition 761*a* extends from the left side surface of the generator body 71 toward the right side surface of the generator body 71. The second partition 761*b* extends from the right side surface of the generator body 71 toward the left side surface of the generator body 71. The third partition 761*c* extends from the left side surface of the generator body 71 toward the right side surface of the generator body 71. The first to third of second partitions 761*a*, 761*b* and 761*c* are spaced apart from each other by a predetermined distance L2, and the curved free ends, e.g., flow inflection portions B2*a*, B2*b*, or B2*c* of the first to third of second partitions 761*a*, 761*b* and 761*c*, do not contact the left or right side surfaces of the generator body 71.

The third flow channel 77, which serves to guide fluid having passed through the second flow channel 76 toward the discharge part 73, may be disposed at any position of the second body 715 as long as the third flow channel 77 communicates with the discharge part 73. The third flow channel 77 may be defined by at least one partition 771 provided in the storage compartment 713.

When the third flow channel 77 is configured to have flow inflection portions B3*a* and B3*b*, the third partition 771 may include first and second partitions 771*a* and 771*b*, which also extend in opposite directions. The first and second of third partitions 771*a* and 771*b* may be spaced apart from each other by a predetermined distance L3, and that the free ends of the first and second of third partitions 771*a* and 771*b* do not contact the left or right surfaces of generator body 71.

Although FIG. 4 illustrates an example in which each of the flow channels 75, 76 and 77 has a plurality of flow inflection portions in the height direction of the generator body 71 (i.e. fluid flows in the width direction of the generator body 71), it is alternatively possible for each of the flow channels 75, 76 and 77 to have a plurality of flow inflection portions in the width direction of the generator body 71 (fluid flows in the height direction of the generator body 71).

The flow channel is designed to have the plurality of flow inflection portions because the heating part or heater 78 heats the generator body 71 rather than directly heating the fluid in the flow channel. In the steam generator 7, the fluid in the flow channels exchange heat with the generator body 71 that is heated by the heating part 78, and it is advantageous to increase the length between the introduction part 72 and the discharge part 73 in terms of heating the fluid in the flow channel. The flow inflection portions serve to supply a sufficient amount of heat to the inside of the flow channel while minimizing the volume of the generator body 71.

Furthermore, since the respective flow channels 75, 76 and 77 are configured such that the direction in which fluid flowing toward a flow inflection portion flows and the direction in which the fluid having passed through the flow inflection portion flows are opposite to each other, it is possible to maximize the flowing distance of the fluid, thus enabling optimal realization of the above-mentioned heat exchange effect. The steam generator may also increase the pressure of steam discharged from the generator body 71 (it is possible to supply steam to the entire container) more than a boiling type, which is designed to generate steam by heating a predetermined amount of fluid stored in the container.

The fluid flowing along the flow channel (i.e. fluid having kinetic energy is heated) is heated whereas in the boiling type steam generator, is a predetermined amount of fluid is supplied to the storage compartment, the supply of the fluid is halted, and the fluid is then heated (i.e. fluid having no kinetic energy is heated). Further, fluid introduced in the third flow channel has a higher pressure than fluid flowing in the first or second flow channel because the fluid is boiled as the fluid moves from the first flow channel to the third flow channel, whereas the boiling type steam generator can generate steam only when all of the fluid stored in the container reaches the boiling point.

Although this embodiment of the present disclosure has been described based on an example in which the flow channel includes all of the first flow channel 75, the second flow channel 76 and the third flow channel 77, it still falls within the scope of the present disclosure even if the third flow channel is omitted. In other words, if the second flow channel 76 is configured to guide the fluid supplied from the first flow channel 75 toward the discharge part 73, the third flow channel 77 may be omitted.

As shown in FIG. 3, the heating part 78, which serves to heat the fluid in the flow channel through the generator body 71, may include a first heating part or side 781 connected to one of positive and negative electrodes, a second heating part or side 783 connected to the other of the positive and negative electrodes, and a third heating part or side connector 785 connected between the first heating part 781 and the second heating part 783. The respective heating parts or elements 781, 783 and 785 generate heat using electric power supplied from the power source.

The first heating part 781 and the second heating part 783 are configured to be spaced apart from each other by a predetermined distance in the height direction of the generator body 71. The first heating part 781 and the second heating part 783 are embodied as a bar-shaped heating element extending toward the second flow channel 76 from the third flow channel 77, and which is secured to the first body 711 so as not to be exposed to the flow channel, e.g., the heating parts are not provided in the storage compartment 713.

Although the first heating part 781 and the second heating part 783 are configured to heat both the fluid in the second flow channel 76 and the fluid in the third flow channel 77, they may also be configured to heat only the fluid in the second flow channel 76. Since the fluid (water or droplets) introduced in the generator body 71 is converted into fluid (steam) having a predetermined temperature and pressure while the fluid passes through the second flow channel 76, it is possible to supply steam having a sufficiently high temperature and pressure to the container 3 even though the fluid introduced in the third flow channel 77 is not heated.

The first heating part 781 may include a first heating body or bar 7811, disposed under or next to (depending on orientation of the body 71 to a user) the second flow channel 76, and a first ground body or first electrode 7813, disposed under or next to the third flow channel 77 so as to connect the first heating body 7811 to the positive or negative terminal of the power source. The second heating part 783 may include a second heating body or bar 7831, disposed under or next to the second flow channel 76 and spaced apart from the first heating body 7811 by a predetermined distance, and a second ground body or second electrode 7833 disposed under or next to the third flow channel 77 to connect the second heating body 7831 to the negative or positive terminal of the power source.

The third heating part 785 is configured to connect the first heating body 7811 to the second heating body 7831, and at least a part of the area of the third heating part 785 is positioned under or next to the first flow channel 75. Since both ends of the third heating part 785 (the regions at which cross-sectional areas are increased due to coupling between different heating parts) are connected to the first heating part 781 and the second heating part 783, the region at which the third heating part 785 is connected to the first heating part 781 and the region at which the third heating part 785 is connected to the second heating part 783 generates more heat than other regions of the heating part 78.

When the third heating part 785, in which heat is concentrated, is positioned close to the first flow channel 75, it is possible to prevent the third heating part 785 from being overheated due to the supply of fluid from the introduction part 72. As a result, it is possible to prevent the introduction part 72 or the discharge part 73 from being plugged with the scale that separates from the surface of the generator body 71 due to overheating of the generator body 71.

Unlike the construction shown in FIG. 4 where the third heating part 785 is positioned under or next to the third flow channel 77, and because the regions where the third heating part 785 connect to the first heating part 781 and the second heating part 783 generate more heat than other regions of the heating part 78, the third flow channel 77 has a higher temperature than the the first and second flow channels 75 and 76 are formed.

When the area or region 77 of the third flow channel 77 has a higher temperature than the other regions of the generator body 71, scale adhering to the inner surface of the third flow channel 771 and the build up of scale close to the third flow channel 77 may separate from the surface of the generator body 71. Subsequently, when the scale is separated from the generator body 71, the scale may flow along the flow channels and may plug the introduction part 72 or the discharge part 73.

However, when the third heating part 785 is positioned at the first flow channel 75 as shown in the present embodiment, it is possible to prevent the temperature of the first flow channel 75 from increasing excessively compared to the temperatures of the other flow channels 76 and 77 due to the supply of fluid from the introduction part 72. Accordingly, the present disclosure can solve the problem whereby scale separates from the surface of the generator body 71 due to local heating of the generator body 71 (i.e. imbalance of temperature in the generator body 71). Furthermore, when the third heating part 785 is positioned at the first flow channel 75, a larger amount of heat may be transmitted to the fluid supplied through the introduction part 72, thus shortening the time required for the steam generator 7 to generate steam.

When the third heating part 785 is configured to have a curved bar shape having the inflection portion or curved contour F, the heat generated from the heating part 78 may be concentrated at the area near the inflection portion F, and the imbalance of heat generated from the heating part 78 may thus become excessive. However, even in such a case, when the heating part 78 is embedded in the generator body 71 such that the inflection portion of the third heating part 785 is positioned under or next to the first flow channel 75, it will be possible to prevent the separation of scale attributable to the temperature imbalance of the generator body 71. If the third heating part 785 is configured to have three or more inflection portions, the heating part 78 may be embedded in the generator body 71 such that the third heating part 785 having a large number of inflection portions is positioned under or next to the first flow channel 75.

Consequently, the steam generator 7 and the laundry treatment apparatus 100 including the same may reduce the time required to generate steam and prevent scale from blocking the discharge part 73 or the introduction part 72. Furthermore, in the steam generator 7, the heating part 78 is not exposed to or provided in the storage compartment 713, and it is unnecessary to control the water level in the storage compartment 713. Hence, it is possible to minimize or control the amount of fluid (the amount of water or droplets) supplied to or flowing in the steam generator.

For the purpose of shortening the time required for steam generation, the cross-sectional area of the second flow channel 76, taken in the direction perpendicular to the moving direction of fluid, may be larger than that of the first flow channel 75 or the third flow channel 77. When the flow rate through the introduction part 72 is constant, the flow velocity is decreased as the cross-sectional area of the flow channel is increased. Accordingly, since the flow velocity of fluid passing through the second flow channel 76 is decreased when the cross-sectional area of the second flow channel 76, taken in the direction perpendicular to the flowing direction of fluid, is larger than those of other flow channels 75 and 77, the time during which fluid passing through the second flow channel 76 exchanges heat with the generator body 71 is increased.

Meanwhile, when the cross-sectional area of the first flow channel 75 or the third flow channel 77, take in the direction perpendicular to the flowing direction of fluid, is smaller than that of the second flow channel 76, the time during which fluid is supplied to the second flow channel 76 through the first flow channel 75 and the time during which fluid moves to the discharge part 73 through the third flow channel 77 are decreased. When the cross-sectional areas of the respective flow channels are controlled as described above, it is possible to further shorten the time required for the steam generator 7 to generate steam.

When the partitions 751, 761 and 771 defining the respective flow channels have the same width in a horizontal direction, as shown in FIG. 4, the above-described effects may be achieved by making the height L2 of the second flow channel 76 in the vertical direction greater than the height L1 of the first flow channel 75 or the height L3 of the third flow channel 77. The term "height" and "width" are being used in view of the orientation of the steam generator shown in FIGS. 2 and 3. Alternatively, the width of each of the partitions in each flow channel may be varied.

If the first flow channel 75 (the height L1 of the first flow channel 75) is configured to have a cross-sectional area different from the cross-sectional area of the third flow channel 77 (the height L3 of the third flow channel 77), the cross-sectional area of the third flow channel 77 is designed to be smaller than the cross-sectional area of the first flow channel 75. As a result, the velocity of fluid sprayed through the discharge part 73 is increased, thus enabling the sprayed fluid to reach the first support 17.

In order to prevent scale in the generator body 71 from moving along the flow channels despite the provision of the heating part 78 having the above-mentioned characteristic, the generator body 71 may further be provided with a sticking space (adhering space), to which scale sticks and protrusions for blocking the movement of scale. Since scale is generated by components (calcium, magnesium, basic substances, and the like) contained in fluid, which adhere with each other and remain in the generator body 71 when the fluid introduced in the generator body 71 evaporates, scale formation may be excessive at the second flow channel 76, where the phase-change of fluid from liquid to steam occurs. Accordingly, the protrusions may be provided as second flow channel protrusions 718 provided in the second flow channel 76.

Figure 4B:
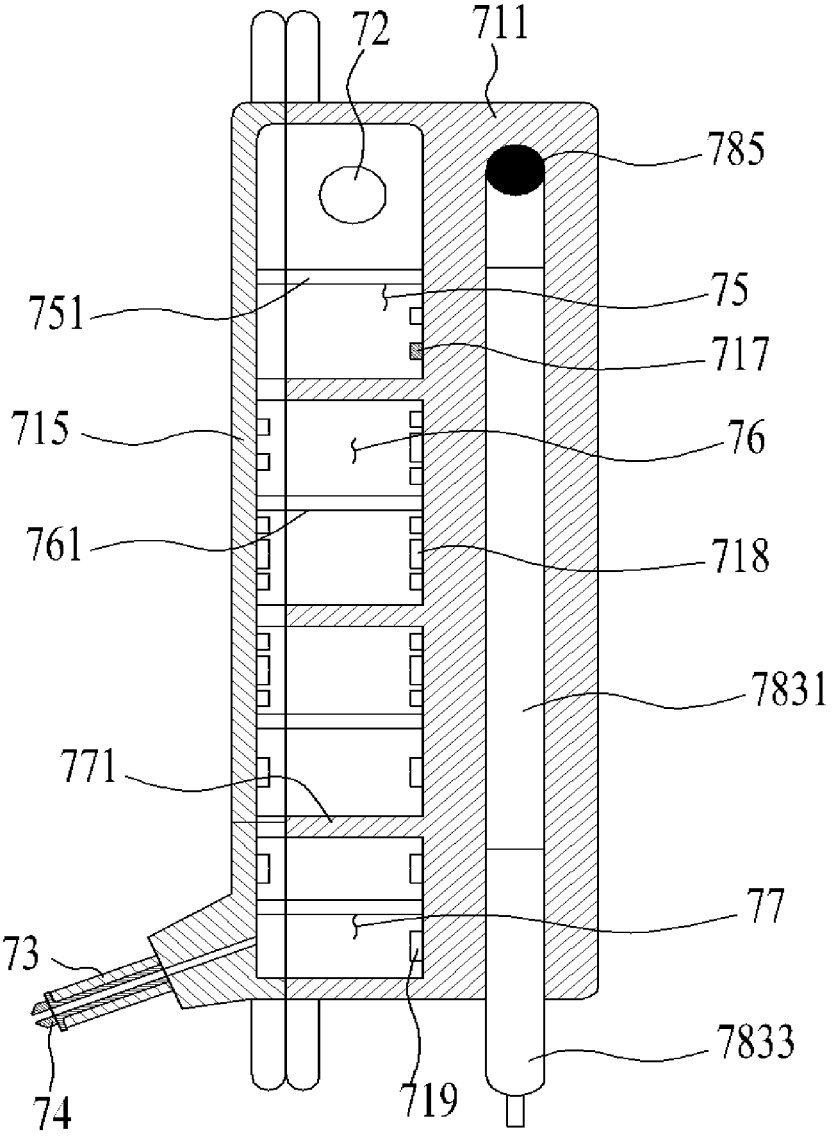

However, since scale may also be generated by mechanisms other than the above-described mechanism, the protrusion may further include first flow channel protrusions 717 provided in the first flow channel 75 and third flow channel protrusions 719 provided in the third flow channel 77. In this case, the number of second flow channel protrusions 718 may be greater than that of the first flow channel protrusions 717 or the third flow channel protrusions 719. The protrusions may be provided only on the inner surface of the first body 711, or may be provided on both the inner surface of the first body 711 and the inner surface of the second body 715, as shown in FIG. 4B.

Figure 5:
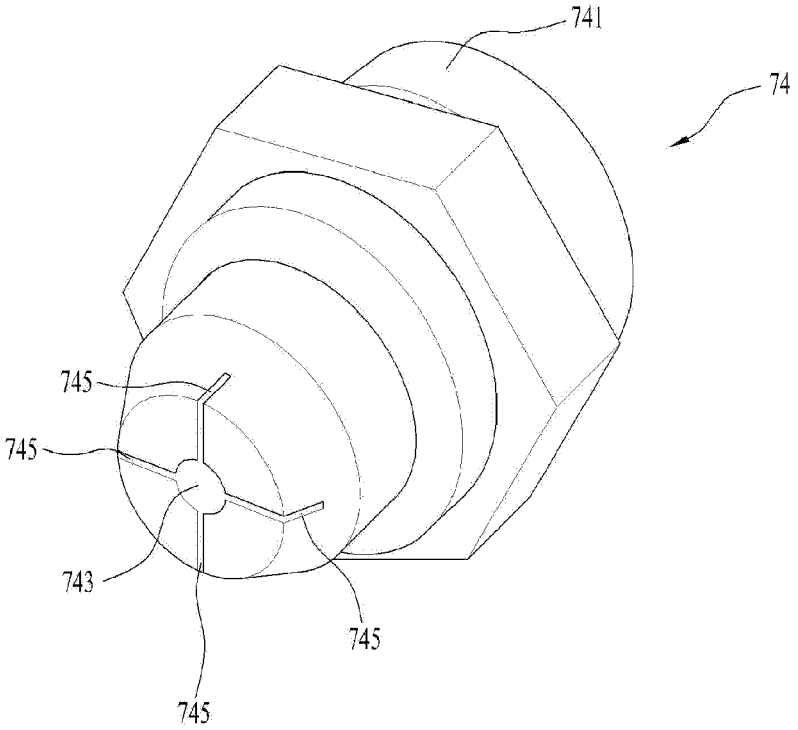
FIG. 5 is a perspective view showing a nozzle according to the embodiment of the present disclosure.

In order to prevent the discharge part 73 from being plugged with scale despite the provision of the heating part 78 and the protrusions 717, 718 and 719, the discharge part 73 may further include a nozzle 74 having a diameter that varies in accordance with the change of pressure. As shown in FIG. 5, the nozzle 74 may include a nozzle body 741 fitted in the discharge part 73, a body through hole 743 formed through the nozzle body 741 to define a passage through which fluid is discharged, and slits 745 formed in the front end of the nozzle body 741 to allow the body through hole 743 to communicate with the outside of the nozzle body 741. When the internal pressure of the generator body 71 is increased due to the introduction of scale into the body through hole 743, the slits allow increase in the diameter of the body through hole 743 an allow the scale to be discharged through the nozzle 74.

Figure 6A:
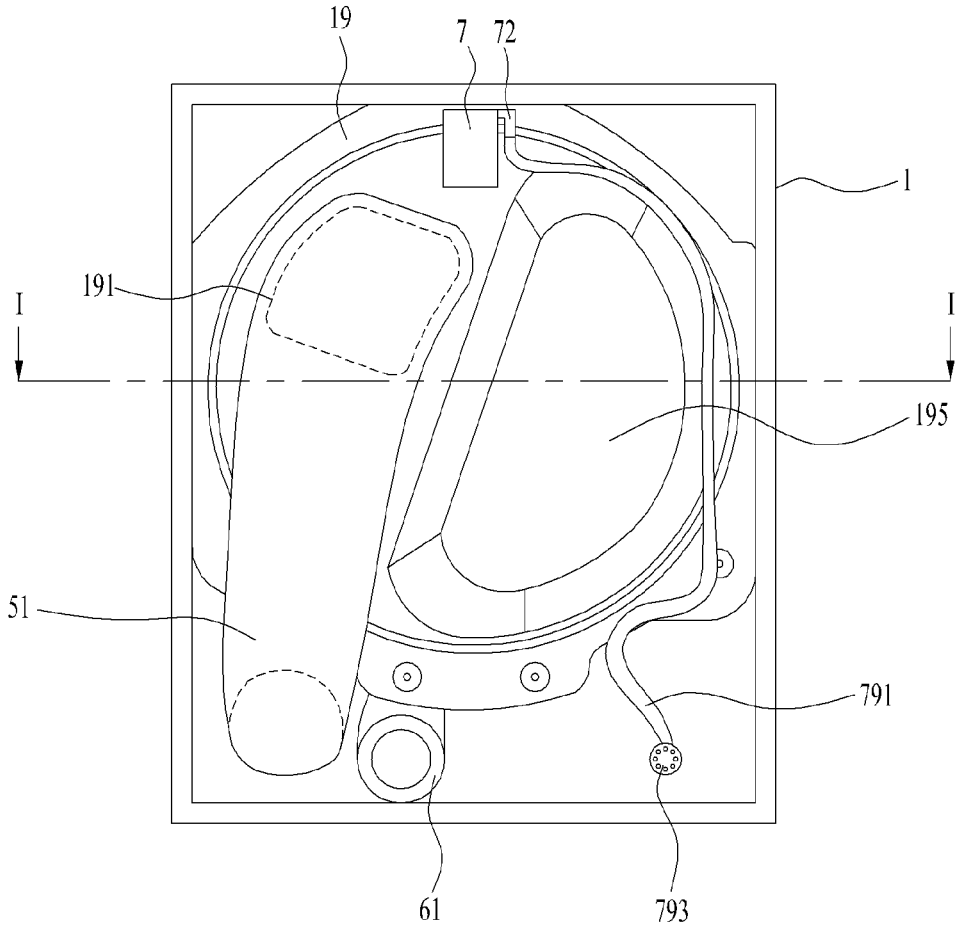
FIGS. 6A and 6B are rear views showing a water supply unit according to the embodiment of the present disclosure.
Figure 6B:
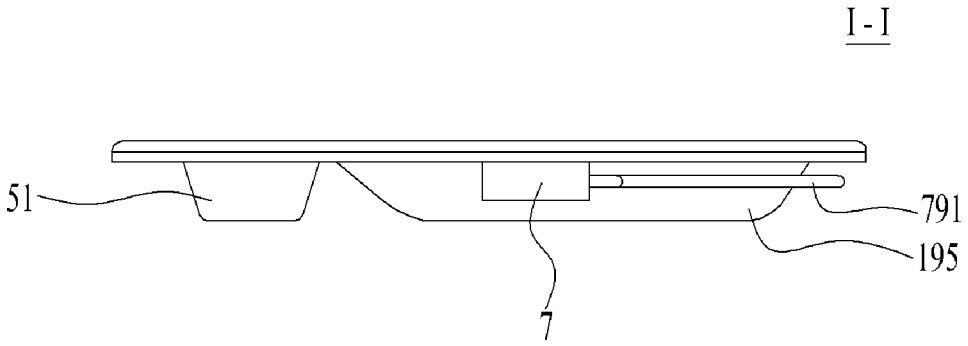

FIG. 6 shows the water supply unit 79, which serves to shorten the time required to generate steam by causing the fluid supplied to the steam generator 100 to exchange heat with the container 3. The water supply unit 79 includes a water supply pipe 791 positioned at least one of the first support 17 and the second support 19 to exchange heat therewith. FIG. 6 illustrates an example in which the water supply pipe 791 exchanges heat with the second support 19.

It may be advantageous to increase the length of the water supply pipe 791 positioned close enough to the container 3 such that the water supply pipe 791 can exchange heat with the container 3. When the steam generator 7 is secured to an upper portion (which is a position that is advantageous for supplying steam up to the first support 17) of the second support 19, the water supply unit 79 may include a valve 793, positioned below the rotational center of the container body 31 and connected to the water source, and the water supply pipe 791, connected between the valve 793 and the introduction part 72 and contacting the outer surface of the second support 19.

The second support 19 may further include a bulging portion or bulge 195 convexing toward the cabinet 1 from the surface of the second support 19 so as to increase the storage capacity of the container 3. In this case, the water supply pipe 791 surrounds the outer circumferential surface of the bulging portion 195.

Although the laundry treatment apparatus 100 has been described based on a drying apparatus capable only of drying laundry, the laundry treatment apparatus 100 may also be applied to an apparatus capable of washing laundry. In this case, the container 3 may include a tub disposed in the cabinet 1 to contain water and a drum rotatably disposed in the tub to contain laundry, and the steam generator 7 should be constructed such that the discharge part 73 supplies steam to the inside of the tub. The hot air supply unit 5 and the discharge unit 6 may communicate with the tub, and the water supply unit 79 may include the valve 793, positioned below the rotational center of the drum and connected to the water source and the water supply pipe 791, connected between the valve 793 and the introduction part 72 and contacting the outer surface of the tub.

Since laundry has different moisture content depending on the type thereof, the laundry may be damaged when heated air (hot air) is supplied to the container 3 for a period of time that is determined based on the amount of laundry (i.e. the amount of clothes). Since the time required for laundry having a higher moisture content to be dried to a desired level (target dryness) and the time required for laundry having a lower moisture content to be dried to the desired level (target dryness) are different from each other, the laundry having a lower moisture content may be damaged due to overdrying when hot air is supplied to the container 3 from the hot air supply unit 5 and the discharge unit 6 until both types of laundry contained in the container 3 reach the target dryness.

Figure 7:
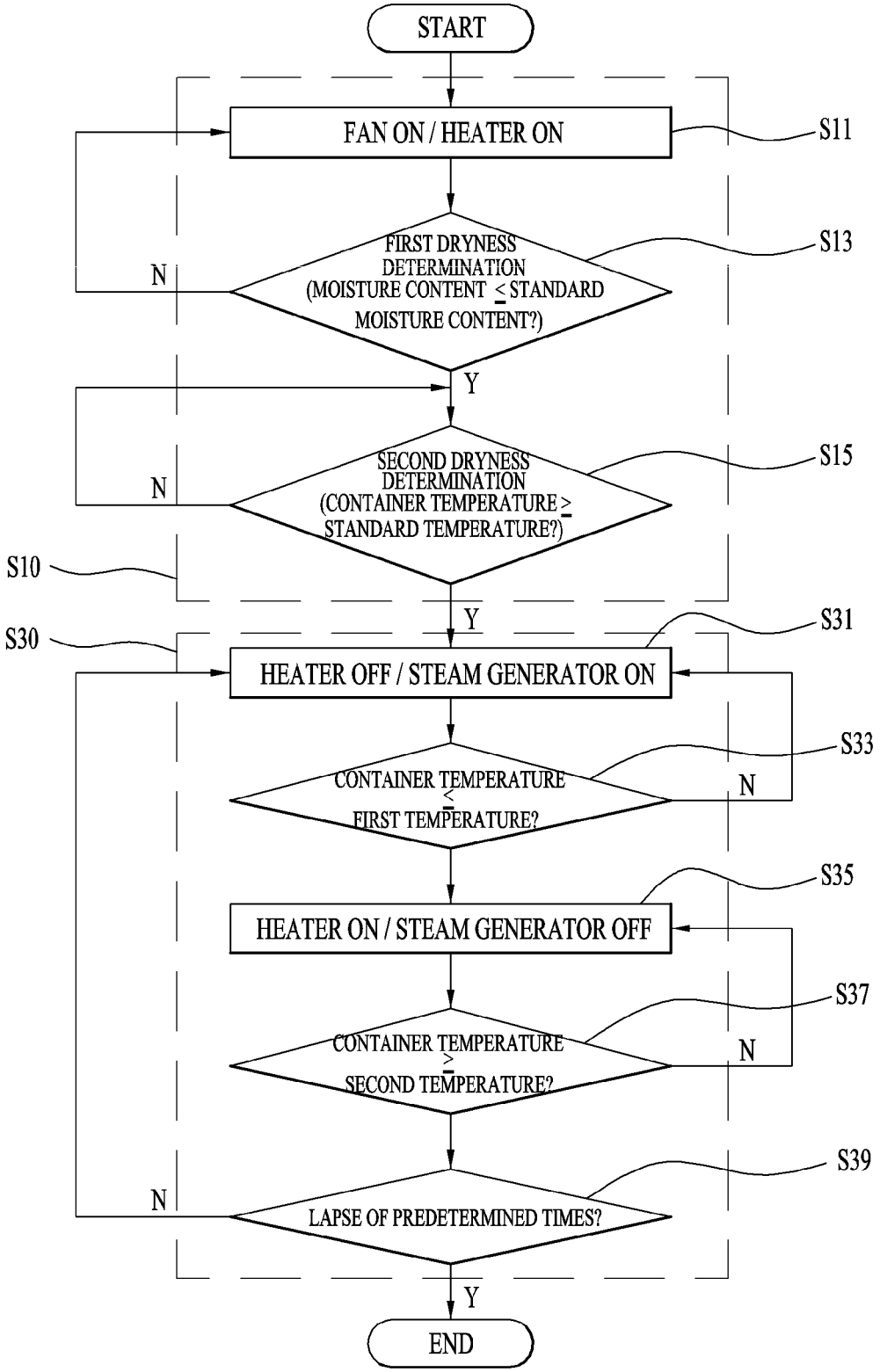
FIG. 7 is a flowchart showing the method of controlling the laundry treatment apparatus according to an embodiment of the present disclosure.

In order to solve the above problem, the present disclosure provides a method of controlling the laundry treatment apparatus as shown in FIG. 7. The method is configured to supply moisture to laundry when the laundry reaches a predetermined level of dryness and to prevent laundry having a lower moisture content (laundry that has already reached the target dryness) from being damaged while laundry having a higher moisture content (laundry that has not yet reached the target dryness) is still being dried.

The method of controlling a laundry treatment apparatus according to the present disclosure includes a first operation of supplying heated air (hot air) to laundry (S10), and a second operation of alternately supplying steam and hot air to the laundry after the first operation S10. The first operation S10 is configured to supply hot air to the container 3 by activating the heater 53 of the hot air supply unit 5 and the fan 63 of the discharge unit 6 until the laundry reaches a predetermined standard dryness.

The operation of determining whether or not the laundry contained in the container 3 has reached the standard dryness may be implemented merely by a first dryness determination operation S13 of determining whether the moisture content of the laundry is lower than a predetermined level of moisture content.

Various methods may be used to determine the moisture content of laundry. The moisture content of laundry decreases as the dryness of the laundry is increased. The first dryness determination operation S13 is configured to determine the dryness of laundry using this phenomenon.

The first dryness determination operation S13 may be performed by a first sensor disposed to contact the laundry contained in the container 3 and to generate different electric signals depending on the moisture content of the laundry, and a controller for comparing data (voltage or current data) sent from the first sensor with standard data (moisture content). The first sensor may be secured to the first support 17 or the second support 19 so as to contact the laundry in the container body 31.

The operation of determining whether or not the dryness of laundry contained in the container 3 has reached the standard dryness may further include an additional second dryness determination operation S15 to determine whether the temperature of air discharged from the container 3 has reached a predetermined standard temperature. The second dryness determination operation S15 may be performed in any manner, as long as the operation is capable of measuring the temperature inside the container 3 or the temperature of the air discharged from the container 3.

Since the amount of heat exchanged between the hot air supplied to the container 3 and the laundry is decreased as the dryness of the laundry is increased, the temperature of the air discharged from the container 3 is increased as the dryness of the laundry is increased. The second dryness determination operation S15 is configured to determine the dryness of the laundry using this phenomenon. The second dryness determination operation S15 may be performed by a second sensor disposed at the supply duct 51 to measure the temperature of the air discharged from the container 3, and a controller for comparing the temperature data sent from the second sensor with standard data (temperature).

In the case where both the first dryness determination operation S13 and the second dryness determination operation S15 are performed, the second dryness determination operation S15 may be performed after the completion of the first dryness determination operation S13. This is because the first dryness determination operation S13 is performed to determine whether even one of multiple types of laundry has been dried to such a degree as to reach the standard moisture content, and the second dryness determination operation S15 is performed to check whether or not the first dryness determination operation S13 was erroneously performed.

When it is determined that the dryness of the laundry has reached the standard dryness, the method performs the second operation S30 of alternately performing a moisture supply operation S31 and a hot air supply operation S35. The moisture supply operation S31 is configured to supply moisture to the inside of the container 3 in order to prevent deformation of laundry caused by overdrying. Accordingly, the moisture supply operation S31 may be configured to supply steam to the container 3, or may also be configured to supply water (droplets) that have not been heated to the container 3.

However, since there is laundry that has not been dried to a desired drying degree as well as overdried laundry in the container 3, the moisture supply operation S31 may be configured to supply steam to the container 3 because the time required for drying may be increased when the temperature inside the container 3 is decreased due to the spraying of the droplets. When the moisture supply operation S31 is configured to supply steam to the container 3, the controller controls the steam generator 7 to be activated and the means for supplying hot air (the heater and the fan) to be deactivated.

While performing the moisture supply operation S31, the controller controls the container body 31 to be rotated by the motor 41. Since damage to laundry caused by overdrying may occur not only to different types of laundry but also to a single type of laundry when there is a great temperature difference between the portion of the laundry that is exposed to hot air and the portion of the laundry that is not exposed to hot air, it is possible to prevent damage to a specific type of laundry by rotating the container body 31 during the moisture supply operation S31.

The steam generator 7, which is used in the moisture supply operation S31, is capable of supplying steam having a high pressure to the container 3 as described above. Accordingly, the present disclosure has the effects of being capable of supplying steam even to laundry that is close to the first support 17, even though the steam generator 7 supplies steam from the side at which the second support 19 is positioned, and also of being capable of also supplying steam even to underlying laundry, other than the laundry at the top, even when many pieces of laundry are piled up.

When the moisture supply operation S31 commences, the controller determines, using the second sensor, whether the temperature of the air in the container 3 is equal to or below a predetermined first temperature in order to prevent the temperature of the air in the container 3 from falling below the first temperature (S33), in order to prevent the reduction in the temperature inside the container 3 from increasing the drying time. When the temperature inside container 3 is equal to or below the first temperature, the method according to the present disclosure commences the hot air supply operation S35 of supplying hot air to the container 3.

The hot air supply operation S35 is configured such that the controller stops the operation of the steam generator 7 but activates the heater 53 and the fan 63. The hot air supply operation S35 continues until the temperature inside the container 3 reaches a predetermined second temperature (higher than the first temperature). The second temperature may be set to be a temperature equal to the standard temperature, or may be set to be a temperature below the standard temperature but higher than the first temperature.

The moisture supply operation S31 and the hot air supply operation S35 are alternately performed so as to maintain the temperature inside the container 3 within a predetermined temperature range (the lower limit of which is the first temperature and the upper limit of which is the second temperature), thereby preventing the drying time from increasing thanks to the maintenance of the temperature inside the container 3 within the temperature range. The moisture supply operation S31 and the hot air supply operation S35 may be terminated after being executed a predetermined number of times.

Although not shown in the drawings, the method according the present disclosure may further include a third operation of supplying air that has not been heated to the laundry after completion of the second operation so as to decrease the temperature of the laundry that has not been heated by the hot air and steam.

As is apparent from the above description, the present disclosure provides a steam generator and a laundry treatment apparatus including the same, which are capable of shortening the time required for steam generation.

Furthermore, the present disclosure provides a steam generator and a laundry treatment apparatus including the same, which are capable of supplying steam having a high pressure.

In addition, the present disclosure provides a steam generator and a laundry treatment apparatus including the same, which are capable of preventing a discharge part, through which steam is discharged, from being plugged with scale when supplying steam having a high pressure.

Furthermore, the present disclosure provides a steam generator and a laundry treatment apparatus including the same, which are capable of minimizing the temperature imbalance thereof and thus minimizing the separation of scale from the surface of the steam generator.

In addition, the present disclosure provides a steam generator and a laundry treatment apparatus including the same, which are capable of minimizing an amount of water consumption.

In accordance with the purpose of the disclosure, a method of controlling a laundry treatment apparatus may include a first operation of supplying hot air to laundry until the dryness of the laundry reaches a predetermined standard dryness and a second operation of alternately performing a moisture supply operation of supplying moisture to the laundry and a hot air supply operation of supplying hot air to the laundry. The moisture supply operation may be performed so as to supply steam to the laundry. The method may further include rotating a container containing the laundry during the moisture supply operation. The second operation may be performed to alternately perform the moisture supply operation and the hot air supply operation based on the temperature of the container containing the laundry.

In the second operation, the hot air supply operation may be performed when the temperature of the container is equal to or below a predetermined first temperature, and the moisture supply operation may be performed when the temperature of the container is equal to or above a predetermined second temperature, which is set to be higher than the first temperature.

In the first operation, it may be determined that the dryness of the laundry has reached the predetermined standard dryness when the moisture content of the laundry is equal to or less than a predetermined moisture content.

The first operation may further include a first dryness determination operation of determining whether the moisture content of the laundry is equal to or less than a predetermined standard moisture content and a second dryness determination operation of determining whether the temperature of a container containing the laundry has reached a predetermined standard temperature.

The moisture content of the laundry may be measured by a first sensor which contacts the laundry and generates different electrical signals depending on the moisture content of the laundry, and the temperature of the container may be measured by a second sensor for measuring the temperature of air discharged from the container.

The method may further include a third operation of supplying air that has not been heated to the laundry after completion of the second operation.

Any reference in this specification to "one embodiment," "an embodiment," "example embodiment," etc., means that a particular feature, structure, or characteristic described in connection with the embodiment is included in at least one embodiment of the disclosure. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A method of controlling a laundry treatment apparatus comprising:

supplying hot air to laundry until a dryness of the laundry reaches a predetermined level of dryness; and alternately supplying moisture to the laundry and supplying hot air to the laundry, wherein the supplying of moisture and hot air is alternated based on a temperature of a container containing the laundry, and wherein, in the alternating supply of moisture and hot air, the hot air is supplied when a temperature of the container is equal to below a predetermined first temperature, and the moisture is supplied when a temperature of the container is equal to or above a predetermined second temperature, which is set to be higher than the first temperature.

2. The method according to claim 1, wherein steam is provided as moisture.

3. The method according to claim 2, further comprising rotating a container containing the laundry during the supplying of moisture.

4. The method according to claim 1, wherein, the dryness of the laundry has reached the predetermined level of dryness when a moisture content of the laundry is equal to or less than a predetermined moisture content.

5. The method according to claim 1, wherein a determination of the predetermined level of dryness comprises:

determining whether a moisture content of the laundry is equal to or less than a predetermined level of moisture content; and determining whether a temperature of a container containing the laundry reaches a predetermined temperature.

6. The method according to claim 5, wherein the moisture content of the laundry is measured by a first sensor which contacts the laundry, and the temperature of the container is measured by a second sensor configured to measure a temperature of air discharged from the container.

7. The method according to claim 1, further comprising supplying air that has not been heated to the laundry after completion of the alternating supply of moisture and hot air.

8. The method of claim 1, wherein moisture is provided by a steam generator, the steam generator having:

a generator body including an inlet through which fluid is introduced and an outlet through which the fluid is discharged;

a first flow channel providing a flow path for the fluid introduced into the generator body through the inlet;

a second flow channel to guide the fluid from the first flow path to the outlet; and a heater to heat the generator body, the heat of the generator body heating the first and second flow channels, and greater amount of heat being provided at the first flow channel than the second flow channel.

* * * * *